US005503463A

United States Patent [19]

Ojanen

[11] Patent Number: 5,503,463

[45] Date of Patent: Apr. 2, 1996

[54] RETAINER SCHEME FOR CUTTING TOOL

[75] Inventor: Randall W. Ojanen, Bristol, Tenn.

[73] Assignee: Rogers Tool Works, Inc., Evans, Ga.

[21] Appl. No.: 362,703

[22] Filed: Dec. 23, 1994

[51] Int. Cl.[6] ..... E21C 35/197

[52] U.S. Cl. ..... 299/107

[58] Field of Search ..... 299/86, 91, 92

[56] References Cited

U.S. PATENT DOCUMENTS

| | | | |
|---|---|---|---|
| 3,767,266 | 10/1973 | Krekeler | 299/92 |
| 4,201,421 | 5/1980 | Den Besten et al. | 299/86 |
| 4,484,783 | 11/1984 | Emmerich | 299/86 |
| 4,684,176 | 8/1987 | Den Besten et al. | 299/91 |
| 4,728,153 | 3/1988 | Ojanen et al. | 299/92 |
| 4,836,614 | 6/1989 | Ojanen | 299/86 |
| 4,850,649 | 7/1989 | Beach et al. | 299/92 |
| 4,921,310 | 5/1990 | Hedlund et al. | 299/92 |

*Primary Examiner*—David J. Bagnell

*Attorney, Agent, or Firm*—Dickstein, Shapiro & Morin

[57] ABSTRACT

A cutting tool assembly including a cutting bit having a head and a cylindrical shank portion of substantially constant diameter depending from the head as well as a bit holder including a cylindrical bore for receiving the cylindrical shank portion of the cutting bit. The shank portion includes an annular recessed groove, the cylindrical bore includes a notch corresponding to and disposed opposite the annular recessed groove. The cutting tool assembly further includes a retainer sleeve disposed between the shank portion of the cutting bit and the bore of the bit holder and which closely conforms about the shank portion while allowing the shank portion to rotate within the bore. The retainer sleeve includes at least one inwardly prestressed projection closely following the contour of a portion of the recessed groove and at least one outwardly prestressed finger projecting into the notch in a direction opposite the inwardly prestressed projection to retain the cutting bit within the bore of the bit holder and to prevent axial removal of the cutting bit when in use while allowing rotational movement of the cutting bit within the bore.

27 Claims, 2 Drawing Sheets

RETAINER SCHEME FOR CUTTING TOOL

BACKGROUND OF THE INVENTION

1. Field of the Invention

The present invention relates to rotatable cutting tool assemblies and more specifically to rotatable cutting tool assemblies having sleeve retainers for removable attachment of the cutting tool within a bored tool holder.

2. Description of the Related Art

The present invention is directed toward a cutting tool assembly employed in earth working, mining or construction applications wherein a cutting bit is held on a mounting block or bit holder that is affixed to a movable member. Such cutting tool assemblies have been employed for various excavating operations. These excavating operations can include removal of minerals as well as trenching, concrete cutting, road planning and other construction applications. The cutting tools must be held securely in place and yet be free to rotate in order to promote uniform wear on the respective tip portions. While earlier cutting tool assemblies have preformed satisfactorily, certain problems or drawbacks have existed and the subject invention is directed toward overcoming these problems.

Cutting tool assemblies of the prior art often include cutting bits having shank portions with enlarged diameters or sharp, stepped or flanged portions at the rear of the shank. Examples of this type of cutting tool assembly can be found in U.S. Pat. No. 4,201,421 to Den Besten et al. as well as U.S. Pat. No. 4,684,176, also to Den Besten et al. However, the rear shoulder on the shank portion of the cutting bit adds cost to the overall tool assembly and, to that extent, is undesirable. Furthermore, the retaining sleeves which are commonly employed in cutting tool assemblies can become positioned between the enlarged shoulder or stepped diameter of the shanks of the cutting tools of the prior art and the cylindrical bore wall thus wedging the sleeve into the bore and making it difficult to extract the bit from the mounting block. In such cases, the block is usually removed and replaced thus adding to the expense of the excavating operation.

Prior art cutting tool assemblies have also employed cylindrical retainer bore clips which are disposed between the rear stop shoulder on the shank of a cutting bit and the rear face of the mounting block as shown, for example, in FIG. 10 of the '176 patent to Den Besten et al. Retainer clips of this type add cost to the cutting tool assembly and are generally more time consuming during installation and extraction of the cutting bit to the mounting block.

There is a need in the art for a cutting tool assembly wherein the cutting bit will be adequately retained within the mounting block without inadvertent removal of the cutting bit due to the forces acting thereon during excavating operations. Further, there is a need in the art for a cutting tool assembly which eliminates the requirements for rear stop shoulders on the shank of the cutting bit thereby reducing the machining requirements on the bit and otherwise simplifying the system and reducing costs.

The subject invention overcomes the problems in the prior art in a cutting tool assembly having a retainer scheme which effectively and rotatably retains the cutting bit within the mounting block while at the same time preventing inadvertent removal of the cutting bit during excavating operations.

SUMMARY OF THE INVENTION AND ADVANTAGES

The subject invention is directed toward a cutting tool assembly including a cutting bit having a head and a cylindrical shank portion of substantially constant diameter depending from the head and a bit holder including a cylindrical bore for receiving the cylindrical shank portion of the cutting bit. The shank portion includes an annular recessed groove, the cylindrical bore includes a notch corresponding to and disposed opposite the annular groove. The cutting tool assembly also includes a retainer sleeve disposed between the shank portion of the cutting bit and the bore of the bit holder and closely conforming about the shank portion while allowing the shank portion to rotate within the bore. The retainer includes at least one inwardly prestressed projection closely following the contour of a portion of the recessed groove and at least one outwardly prestressed finger projecting into the notch and in a direction opposite the inwardly prestressed projection to retain the cutting bit within the bore of the bit holder and to prevent axial removal of the cutting bit when in use while allowing rotatable movement of the cutting bit within the bore.

In this way, the cutting bit of the cutting tool of the subject invention may be rotatably retained within the bit holder, while, at the same time, successfully resisting axial removal during excavating operations. Furthermore, the cutting tool of the subject invention is cost effective in that the shank portion of the cutting bit does not include raised diameters or stop shoulders as found in the more expensive cutting bits of the prior art.

BRIEF DESCRIPTION OF THE DRAWINGS

Other features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
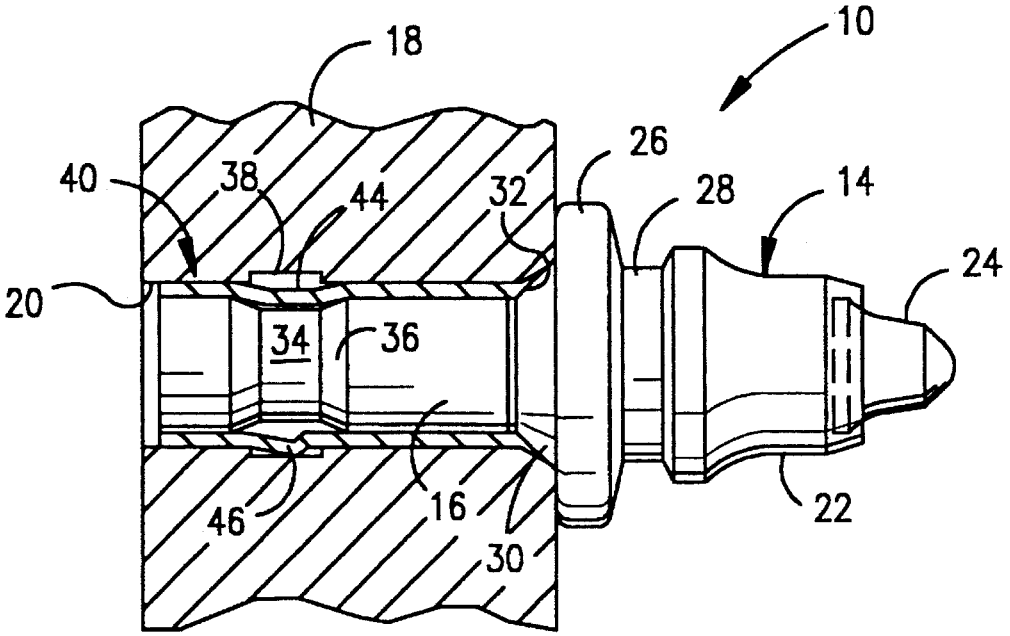
FIG. 1 is a cross sectional side view of the cutting tool assembly of the subject invention.
Figure 2:
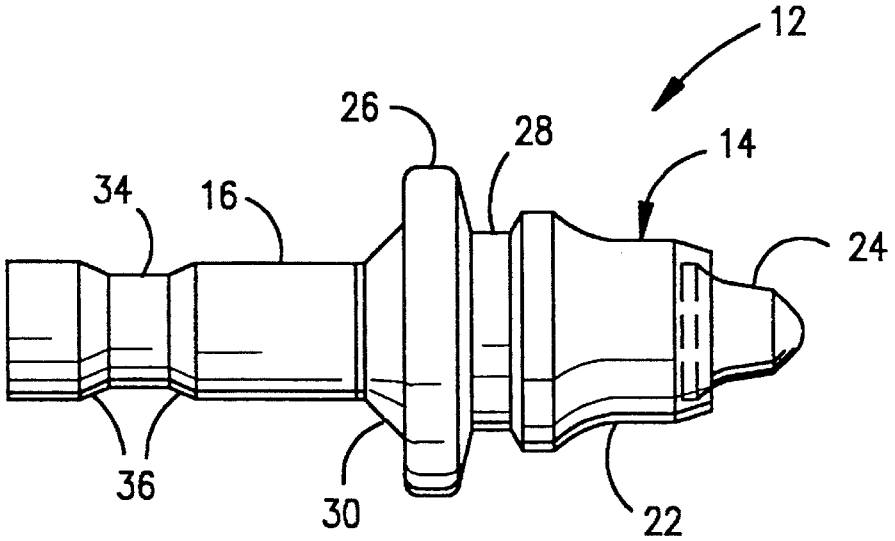
FIG. 2 is a side view of the cutting bit of the subject invention.

Referring now to the drawings and specifically to FIGS. 1 and 2, a cutting tool assembly is generally shown at 10 in FIG. 1. The assembly 10 includes a cutting bit, generally shown at 12 in FIG. 2, having a head, generally indicated at 14 and a cylindrical shank portion 16 of substantially constant outer diameter extending from the head 14. The assembly 10 also includes a bit holder, generally indicated at 18 including a cylindrical bore 20 for receiving the cylindrical shank portion 16 of the cutting bit 12.

The head 14 includes a body 22 and a cutting element 24 disposed on one side of the body 22 and at the distal end of the cutting head 14. The head 14 also includes an annular shoulder 26 disposed on the other end of the body 22 opposite the cutting element 24. The annular shoulder 26 has a diameter larger than the cylindrical bore 20 and is adapted for abutting contact with the bit holder 18. The cutting bit head 14 further includes a pry-out groove 28 disposed between the annular shoulder 26 and the body 22 of the cutting bit head 14. A frustro-conical radiused surface 30 merges between the annular shoulder 26 and the shank portion 16 of the cutting bit 12. The cylindrical bore 20 includes a flared relief 32 at the open end thereof to accommodate the frustro-conical radiused surface 30.

The shank portion 16 includes an annularly recessed groove 34. The annularly recessed groove 34 is bounded on its edges by a pair of annular, chamfered surfaces 36 which extend between the groove 34 and the outer diameter of the shank portion 16. The cylindrical bore 20 includes a notch 38 corresponding to and disposed opposite the annularly recessed groove 34.

Figure 3:
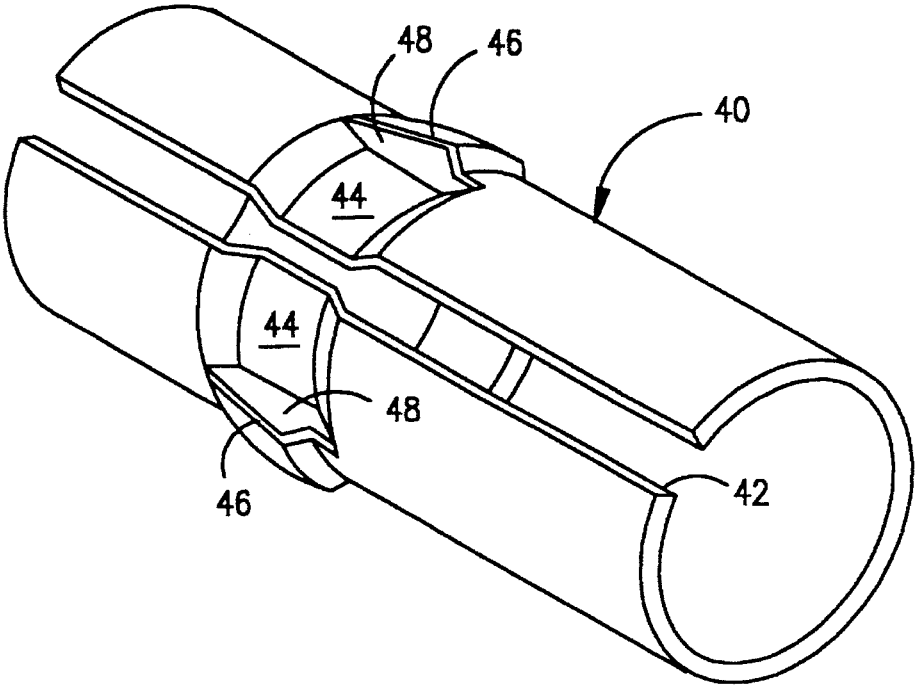
FIG. 3 is a perspective view of the retaining sleeve of the subject invention.

The cutting tool assembly 10 further includes a retainer sleeve, generally indicated at 40 in FIGS. 1 and 3, disposed between the shank portion 16 of the cutting bit 12 and the bore 20 of the bit holder 18 and which closely conforms about the shank portion 16 while allowing the shank portion to rotate within the bore 20. The retainer sleeve 40 is made of resilient spring steel and is cylindrical in shape and includes a slit 42 extending longitudinally along the entire length of the retainer 40. The retainer 40 includes at least one, but preferably a plurality of inwardly prestressed projections 44 which closely follow the contour of a portion of the recessed groove 34 about the circumference thereof. More specifically, the inwardly prestressed projections 44 are spaced relative to one another about the circumference of the retainer sleeve 40 and extend into the recessed groove 34 at spaced intervals about its circumference.

The retainer sleeve 40 also includes at least one but preferably a plurality of, outwardly prestressed fingers 46 which project into the notch 38 and in a direction opposite the inwardly prestressed projections 44. More specifically, the outwardly prestressed fingers 46 are spaced relative to one another about the circumference of the retainer sleeve 40 and extend into the notch 38 at spaced intervals along the radius defined by the annular notch 38. Each of the outwardly prestressed fingers 46 are disposed between a pair of inwardly prestressed projections 44. The retainer sleeve 40 includes a plurality of apertures 48 disposed between adjacent inwardly prestressed projections 44 and outwardly prestressed fingers 46. The apertures 48 each define elongated ellipses having sides which are substantially parallel to each other in the longitudinal direction. The inwardly prestressed projections 44 and outwardly prestressed fingers 46 of the retainer sleeve 40 coact with the recessed groove 34 and annular notch 38 to retain the cutting bit 12 within the bore 20 of the bit holder 18 and to prevent axial removal of the cutting bit when in use while at the same time allowing rotatable movement of the cutting bit within the bore 20.

Figure 4:
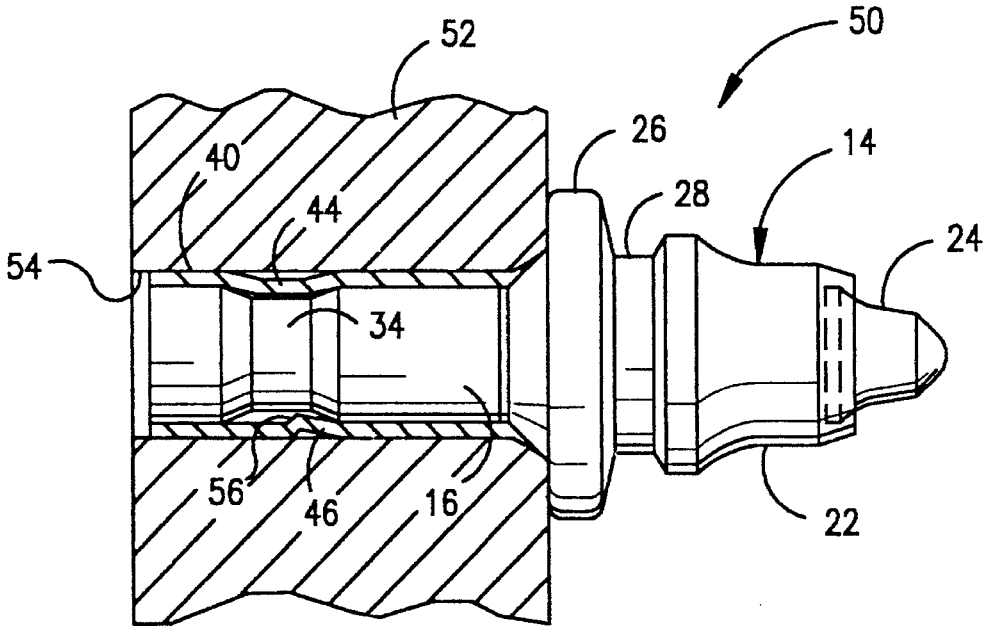
FIG. 4 is a cross sectional side view of an alternative embodiment of the cutting tool assembly of the subject invention.

Another alternative embodiment of the subject invention is illustrated in connection with a cutting tool assembly, generally shown at 50 in FIG. 4 where like numerals are used to designate like elements among the figures. In this embodiment, the bit holder 52 includes a cylindrical bore 54 for receiving the cylindrical shank portion 16 of the cutting bit 12. As with the embodiment shown in FIGS. 1 and 2, the shank portion 16 includes an annularly shaped groove 34. The bit holder 52 does not, however, include the annular notch as illustrated in FIG. 1. In this instance, the cutting tool assembly 50 includes the retainer sleeve 40 which is disposed between the shank portion 16 of the cutting bit 12 and the bore 54 of the bit holder 52. The retainer sleeve 40 closely conforms about the shank portion 16 while allowing the shank portion 16 to rotate within the bore 54. The retainer 40 includes the same structure as shown in FIG. 3 but cooperates with the shank 16 and bore 34 in a different way. More specifically, the retainer 40 includes at least one, but preferably a plurality of, inwardly prestressed projections 44 extending into and closely following the contours of a portion of the recessed groove 34. The retainer 40 also includes at least one, but preferably a plurality of, outwardly prestressed projections 46 which are squeezed between the shank 16 and the bore 52 such that they extend partially into the recessed groove 34 to present an abutment surface 56 relative to the recessed groove 34 to prevent axial removal of the cutting bit while allowing rotational movement thereof during cutting operations.

Thus the retainer sleeve 40 of the subject invention can be employed with both notched and unnotched bit holders. The cutting bit assembly 50 of FIG. 4 enjoys improved retention of the bit 12 in the holder 52 while also allowing free rotation of the shank 16 within the bore 54.

In this way, the cutting bits of the cutting tool assemblies of the subject invention may be rotatably retained within the bit holders, while, at the same time, successfully resisting axial removal during excavating operations. In addition, these objections are met in a cost effective, efficient manner which does not jeopardize tool life nor overly complicate the assembly and disassembly of the cutting tool.

The subject invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A cutting tool assembly, said assembly comprising:

a cutting bit having a head and a cylindrical shank portion of substantially constant outer diameter extending from said head;

a bit holder including a cylindrical bore for receiving said cylindrical shank portion of said cutting bit;

said shank portion including an annularly recessed groove, said cylindrical bore including a notch corresponding to and disposed opposite said annularly recessed groove;

said cutting tool assembly further including a retainer sleeve disposed between said shank portion of said cutting bit and said bore of said bit holder and closely conforming about said shank portion while allowing said shank portion to rotate within said bore, said retainer including at least one inwardly prestressed projection closely following the contour of a portion of said recessed groove and at least one outwardly prestressed finger projecting into said notch and in a direction opposite said at least one inwardly prestressed projection to retain said cutting bit within said bore of said bit holder and to prevent axial removal of said cutting bit when in use while allowing rotatable movement of said cutting bit within said bore.

2. A cutting tool assembly as set forth in claim 1 wherein said retainer sleeve includes a plurality of said inwardly prestressed projections spaced relative to one another about the circumference of said retainer sleeve.

3. A cutting tool assembly as set forth in claim 2 wherein said retainer sleeve includes a plurality of said outwardly prestressed fingers spaced relative to one another about the circumference of said retainer sleeve.

4. A cutting tool assembly as set forth in claim 3 wherein each of said outwardly prestressed fingers are disposed between a pair of said inwardly prestressed projections.

5. A cutting tool assembly as set forth in claim 4 wherein said retainer sleeve is cylindrical in shape and includes at least one slit extending longitudinally along said retainer.

6. A cutting tool assembly as set forth in claim 5 wherein said retainer sleeve includes a plurality of apertures disposed between adjacent inwardly prestressed projections and outwardly prestressed fingers.

7. A cutting tool assembly as set forth in claim 6 wherein said apertures each define elongated ellipses having sides which are substantially parallel to each other in the longitudinal direction.

8. A cutting tool assembly as set forth in claim 7 wherein said annularly recessed groove is bounded on its edges by a pair of annular, chamfered surfaces which extend between said groove and said outer diameter of said shank portion.

9. A cutting tool assembly as set forth in claim 8 wherein said head of said cutting bit includes a body and a cutting element disposed on one side of said body and at the distal end of said cutting head and an annular shoulder disposed on the other end of said body opposite said cutting element, said annular shoulder having a diameter larger than said cylindrical bore and adapted for abutting contact with said bit holder, said cutting bit head further including a pry-out groove disposed between said annular shoulder and said body of said cutting bit head.

10. A cutting tool assembly as set forth in claim 9 wherein said cutting bit further includes a frustro-conical radiused surface merging between said annular shoulder and said shank portion, said cylindrical bore including a flared relief at the opened end thereof to accommodate said frustro-conical radiused surface of said cutting bit.

11. A cutting tool assembly as set forth in claim 5 wherein one of said at least one slit extends the entire length of said retainer.

12. A cutting tool assembly as set forth in claim 5 wherein said at least one slit has a width such that when the edges of said at least one slit are in contact with one another said shank portion of said cutting bit remains rotatable within said bore.

13. A cutting tool assembly as set forth in claim 1 wherein:

said shank portion further includes an anterior segment and a posterior segment, each said segment being adjacent to said recessed groove and having an outer diameter; and said retainer sleeve encompasses said anterior and posterior segments.

14. A cutting tool assembly, said assembly comprising:

a cutting bit having a head and a cylindrical shank portion of substantially constant outer diameter extending from said head;

a bit holder including a cylindrical bore for receiving said cylindrical shank portion of said cutting bit with said shank portion including an annularly recessed groove;

said cutting tool assembly further including a retainer sleeve disposed between said shank portion of said cutting bit and said bore of said bit holder and closely conforming about said shank portion while allowing said shank portion to rotate within said bore, said retainer including at least one inwardly prestressed projection extending into and closely following the contours of a portion of said recessed groove and at least one outwardly prestressed projection extending partially into said recessed groove to present an abutment surface relative to said recessed groove to prevent axial removal of said cutting bit while allowing rotational movement thereof during cutting operations.

15. A cutting tool assembly as set forth in claim 14, wherein said retainer sleeve includes a plurality of inwardly prestressed projections spaced relative to one another about the circumference of said retainer sleeve.

16. A cutting tool assembly as set forth in claim 15 wherein said retainer sleeve includes a plurality of said outwardly prestressed projections spaced relative to one another about the circumference of said retainer sleeve.

17. A cutting tool assembly as set forth in claim 16 wherein each one of said outwardly prestressed projections is disposed between a pair of said inwardly prestressed projections.

18. A cutting tool assembly as set forth in claim 17 wherein said retainer sleeve is cylindrical in shape and includes at least one slit extending longitudinally along said retainer.

19. A cutting tool assembly as set forth in claim 18 wherein said retainer sleeve includes a plurality of apertures disposed between adjacent inwardly prestressed projections and outwardly prestressed projections.

20. A cutting tool assembly as set forth in claim 19 wherein said apertures each define elongated ellipses having sides which are substantially parallel to each other in the longitudinal direction.

21. A cutting tool assembly as set forth in claim 20 wherein said annularly recessed groove is bounded on its edges by a pair of annular, chamfered surfaces which extend between said groove and said outer diameter of said shank portion.

22. A cutting tool assembly as set forth in claim 21 wherein said head of said cutting bit includes a body and a cutting element disposed on one side of said body and at the distal end of said cutting head and an annular shoulder disposed on the other end of said body opposite said cutting element, said annular shoulder having a diameter larger than said cylindrical bore and adapted for abutting contact with said bit holder, said cutting bit head further including a pry-out groove disposed between said annular shoulder and said body of said cutting bit head.

23. A cutting tool assembly as set forth in claim 22 wherein said cutting bit further includes a frustro-conical radiused surface merging between said annular shoulder and said shank portion, said cylindrical bore including a flared relief at the opened end thereof to accommodate said frustro-conical radiused surface of said cutting bit.

24. A cutting tool assembly as set forth in claim 18 wherein one of said at least one slit extends the entire length of said retainer.

25. A cutting tool assembly as set forth in claim 18 wherein said at least one slit has a width such that when the edges of said at least one slit are in contact with one another said shank portion of said cutting bit remains rotatable within said bore.

26. A cutting tool assembly as set forth in claim 14 wherein:

said shank portion further includes an anterior segment and a posterior segment, each said segment being adjacent to said recessed groove and having an outer diameter; and said retainer sleeve encompasses said anterior and posterior segments.

27. A cutting tool assembly comprising:

a cutting bit having a head and a cylindrical shank portion of substantially constant outer diameter extending from said head;

a bit holder including a cylindrical bore for receiving said cylindrical shank portion of said cutting bit with said shank portion including an annularly recessed groove;

said cutting tool assembly further including a retainer sleeve disposed between said shank portion of said cutting bit and said bore of said bit holder and closely conforming about said shank portion while allowing said shank portion to rotate within said bore, said retainer including at least one inwardly rigid prestressed projection extending into and closely following the contours of a portion of said recessed groove and at least one outwardly flexible prestressed projection extending partially into said recessed groove to present an abutment surface relative to said recessed groove to prevent axial removal of said cutting bit while allowing rotational movement thereof during cutting operations.

* * * * *